US007942420B2

(12) United States Patent
Polovnev et al.

(10) Patent No.: US 7,942,420 B2
(45) Date of Patent: May 17, 2011

(54) AQUA SHOOTING RANGE

(75) Inventors: Andrey Albertovich Polovnev, Moscow (RU); Volodymyr Shaymukhametovich Khaziakhmetov, Kharkov (UA)

(73) Assignee: DSG Technology AS, Lorenskog (NO)

( * ) Notice: Subject to any disclaimer, the term of this patent is extended or adjusted under 35 U.S.C. 154(b) by 0 days.

(21) Appl. No.: 11/913,531

(22) PCT Filed: May 3, 2006

(86) PCT No.: PCT/RU2006/000227

§ 371 (c)(1),
(2), (4) Date: Nov. 2, 2007

(87) PCT Pub. No.: WO2006/118486

PCT Pub. Date: Nov. 9, 2006

(65) Prior Publication Data

US 2008/0258396 A1 Oct. 23, 2008

(30) Foreign Application Priority Data

May 4, 2005 (RU) ..... 2005113573

(51) Int. Cl.
*F41J 11/00* (2009.01)

(52) U.S. Cl. ..... 273/404; 273/350; 273/406; 4/505

(58) Field of Classification Search ..... 273/348–350, 273/403–410; 4/489, 505
See application file for complete search history.

(56) References Cited

U.S. PATENT DOCUMENTS

| | | | | | |
|---|---|---|---|---|---|
| 2,209,672 | A * | 7/1940 | Boggs | ..... | 473/578 |
| 2,812,660 | A * | 11/1957 | Marden et al. | ..... | 73/167 |
| 3,095,197 | A * | 6/1963 | Weitzman | ..... | 273/350 |
| 3,582,999 | A * | 6/1971 | Baker | ..... | 4/505 |
| 5,368,307 | A * | 11/1994 | Hotchkiss | ..... | 273/350 |
| 6,511,074 | B1 * | 1/2003 | Fireman | ..... | 273/350 |
| 2003/0118971 | A1 * | 6/2003 | Rogachev | ..... | 434/11 |

FOREIGN PATENT DOCUMENTS

| | | | |
|---|---|---|---|
| GB | 2214620 | A * | 9/1989 |
| GB | 2242730 | A * | 10/1991 |
| RU | 2119144 | C1 * | 9/1998 |
| RU | 2167383 | | 5/2001 |
| SU | 1201464 | | 12/1985 |
| SU | 1744415 | A1 * | 6/1992 |
| SU | 1744415 | A1 | 6/1992 |

* cited by examiner

*Primary Examiner* — Mark S Graham
(74) *Attorney, Agent, or Firm* — Amy Allen-Hinson; Nexsen Preut, LLC

(57) ABSTRACT

The invention relates to sports and entertaining facilities and in particular to aqua shooting ranges. The inventive aqua shooting range comprises a pool (1), an above-water fence, shooting positions (9) with weapons and underwater targets (5). The pool is provided with a transversal partition (6) separating the shooting positions (9) from the underwater targets (5). Each partition (6) is provided with a firing port (8). An additional shooting position (20) for shooting from an above-water position to water is embodied on the partition (6). The above-water part of the pool wall placed above the underwater target (5) and the above-water fence is provided with bullet stoppers (11). The shooting position is located in such a way that the weapon vertical guidance angle is limited to a value equal to or greater than 10 degrees with respect to the horizon. The invention makes it possible to increase the safety, learning, and training efficiency of shooting at underwater targets.

29 Claims, 2 Drawing Sheets

AQUA SHOOTING RANGE

TECHNICAL FIELD

This invention relates to sports and leisure structures containing swimming pools and can be used for teaching, training and carrying out of sporting competitions in shooting under the water and from the air into the water from pneumatic and missile weapons and fire-arms, where it is also possible to combine shooting with speed swimming.

PRIOR ART

The mass popularity of underwater sports and underwater hunting has led to the designing of underwater ammunitions for available fire-arms (see Description to patent RU 2268455, Int. CI.7 F42B 10/38, published 20 Jan. 2006; Ardashev A. N., Fedoseev S. L., "Orudgie specialnoye, neobychnoye, exoticheskoye", Moscow, Voennaya Technika, 2001, pages 172-177) that provide safe training in shooting under the water and from the air into the water against underwater targets. This is possible in underwater shooting galleries called Aquatirs where participants can train and carry out sports competitions for underwater hunters, military divers and sportsmen.

Existing shooting galleries and shooting stands are intended for firing into targets in the air. Under the water, light refraction affects targeting so that in reality the underwater target is not located in the place where it is seen; therefore it is impossible to learn effective shooting under the water and from the air into the water against underwater targets in existing shooting galleries.

It is well known that competitions in underwater shooting from harpoon guns are carried out in swimming pools where targets are installed at the range of 4 m and the shooting line is confined by floating buoys. In the course of competition, the score of a sportsman that breaches that line is cancelled. Defining such a breach is rather difficult to register, especially while shooting in the centre of the swimming pool, and that often results in subjective referees' decisions. The sportsman shoots with one harpoon attached to a line and after the shot, the sportsman pulls the line and extracts the harpoon from the target; this procedure does not raise staginess of competitions (see International Rules on target shooting of <<Confederation Mondiale des Activites Subaquatiques>>, published May, 2002).

The closest analog of this claimed invention is a shooting gallery having a water-filled area where adjacent shooting sections with targets are partitioned off by floating protective shields and an area of fencing comprises a protective screen (see Description to patent RU 2119144, Int. CI. 6 F 41J 1/18, published on 20 Sep. 1998).

Disadvantage of that known structure is a lack of common safety for a shooter. Shooting sections are partitioned off and fenced by protective shields that prevent the instructor from watching actions of the shooter in the section and the shooter from watching actions in the section next to him. Further, the shooting position is not separated from the target and does not allow control of a shooter's motion in the direction of the target. In the case when the shooter is near his target and shooting takes place in the next section, protective shields floating with gaps cannot provide for safety of the shooter near the target because a harpoon or bullet can ricochet from the targets, bottom or firm protective shields.

Moreover, in that known structure, it is suggested that shooting take place in opposite directions in adjacent sections and to mount an upper protective cover on the floats or to use a diving-bell for this purpose. Counter-shooting in opposite directions is prohibited in all shooting galleries under any circumstances, and, in that known structure, protective shields floating with gaps cannot provide safety of the shooter in his own position. Further, harpoons and bullets that fly out of the water can ricochet from the upper cover and get into the adjacent section.

In that known structure of an underwater shooting gallery, it is suggested to make supports for underwater shooters in the form of pads with negative flotation capabilities. It is well known that under the water, a swimmer equipped with ballast weight has zero flotation ability and therefore cannot lie on pads. To retain orientation while making an underwater shot, the shooter must move forward or rest against an obstacle due to imitations of forward motion by use of feet (flippers).

In the Description to patent RU No 2119144, it is stated that this underwater shooting gallery could be assembled and disassembled in several minutes. This is quite impossible if protective shields are adequately durable and safe. Thus, this underwater shooting gallery structure, from the very beginning, fails to have safe shooting conditions.

It is necessary to note that the known structure of an underwater shooting gallery does not enable training and sports competitions in speed swimming combined with shooting against underwater targets.

SUMMARY OF THE INVENTION

The purpose and the technical result of the given invention is the provision of safety and increase of effectiveness of teaching and training in shooting against underwater targets, as well as increase of staginess of sports competitions in swimming and shooting against underwater targets.

The mentioned technical result is provided by the Aqua shooting range (Aquatir) according to the first embodiment, which comprises a water-filled pool formed by walls, an above-water fencing, at least one shooting position with a weapon and at least one underwater target, where the pool is equipped with transverse partitioning that separates the pool swimming area with the shooting position from the underwater target, and where the partition in front of each shooting position has at least one underwater embrasure and the above-water part of the pool wall and the above-water fencing are equipped with bullet-traps.

Moreover, it is equipped with at least one additional shooting position for shooting from the air into the water located on the partition and the underwater target is installed with the capability of restriction to the vertical pointing angle of the weapon that is not less than 10 degrees relative to the horizon.

Moreover, the partition has at least one ladder to climb out from the swimming part of the pool.

Moreover, the partition is made of transparent material, partially or completely.

Moreover, the underwater target is installed with the capability of restriction as to the vertical pointing angle of the weapon from the underwater embrasure that is not less than 1 degree relative to the horizon.

Moreover, the underwater target is made of metal as a plane figure and is installed with the capability of horizontal rotation from the shooting position in the window of the metal frame with an upper shield.

Moreover, the underwater target is made of fragile material as a plane figure and is installed in the window of the metal frame with an upper shield.

Moreover, the underwater target is an inflatable figure and is equipped with an anchor.

Moreover, the underwater target is a transparent inflatable figure with a source of light of permanent or periodic effect inside and is equipped with an anchor.

Moreover, the underwater target is an inflatable figure, is equipped with weight and is suspended on a floating buoy with the capability of motion in the horizontal and/or the vertical plane.

Moreover, the underwater target is a transparent inflatable figure with a source of light of permanent or periodic effect inside, is equipped with weight and is suspended on a floating buoy with the capability of motion in the horizontal and/or the vertical plane.

Moreover, the underwater target is an inflatable figure, is equipped with weight and is suspended on the mechanical drive with the capability of motion in the horizontal and/or the vertical plane.

Moreover, the underwater target is a transparent inflatable figure with a source of light of permanent or periodic effect inside, is equipped with weight and is suspended on the mechanical drive with the capability of motion in the horizontal and/or the vertical plane.

Moreover, captured live fish swimming in the area enclosed by a net are used as a target.

Moreover, harpoon guns with harpoons having weighted head and light-weight aft part are used as a weapon, and the wall of the swimming pool behind the target has a protective screen.

Moreover, bows and/or arbalests with arrows having weighted arrow-head and light-weight aft part without empennage are used as a weapon, and the wall of the swimming pool behind the target has a protective screen.

Moreover, firearms are used as a weapon, and the wall of swimming pool behind the target is equipped with a bullet-trap and the bottom and side walls of the pool have protective screens.

Moreover, behind and on the sides of the shooting position are mounted sound-absorbing shields.

Moreover, the weapon is installed in a mount with restriction of the weapon rotation in the horizontal and the vertical plane.

Moreover, the weapon includes a laser target designator in a sealed casing.

Moreover, the bullet-trap includes a changeable decorative coating.

An Aquatir according to the second embodiment includes a water-filled pool formed by walls, an above-water fencing, at least one shooting position with a weapon and at least one underwater target, where according to the invention, the shooting position is located above the water on one side of the pool and the underwater target is installed with the capability of restriction as to vertical pointing angle of the weapon that is not less than 10 degrees relative to the horizon and located behind the underwater target and the above-water part of the pool wall and above-water fencing are equipped with bullet-traps.

Moreover, the pool is equipped with a transverse partition that separates the pool swimming area from the underwater target, and where the shooting position is located on the partition having at least one ladder to climb out from the swimming part of the pool.

Moreover, the underwater target is made of metal as a plane figure and is installed with the capability of rotation from the shooting position in the window of a metal frame with an upper shield.

Moreover, the underwater target is made of fragile material as a plane figure and is installed in the window of a metal frame with an upper shield.

Moreover, the underwater target is an inflatable figure and is equipped with an anchor.

Moreover, the underwater target is a transparent inflatable figure with a source of light of permanent or periodic effect inside and is equipped with an anchor.

Moreover, the underwater target is an inflatable figure, is equipped with weight and is suspended on a floating buoy with the capability of motion in the horizontal and/or the vertical plane.

Moreover, the underwater target is made as a transparent inflatable figure with a source of light of permanent or periodic effect inside, is equipped with weight and is suspended on a floating buoy with the capability of motion in the horizontal and/or the vertical plane.

Moreover, the underwater target is an inflatable figure, is equipped with weight and is suspended on the mechanical drive with the capability of motion in the horizontal and/or the vertical plane.

Moreover, the underwater target is a transparent inflatable figure with a source of light of permanent or periodic effect inside, is equipped with weight and is suspended on the mechanical drive with the capability of motion in the horizontal and/or the vertical plane.

Moreover, captured live fish swimming in an area enclosed by a net are used as a target.

Moreover, harpoon guns with harpoons having weighted head and light-weight aft part are used as the weapon, and the wall of the swimming pool behind the target has a protective screen.

Moreover, bows and/or arbalests with arrows having weighted arrow-head and light-weight aft part without empennage are used as the weapon, and the wall of the swimming pool behind the target has a protective screen.

Moreover, fire-arms are used as the weapon, and the wall of the swimming pool behind the target is equipped with a bullet-trap and the bottom and side walls of the pool have protective screens.

Moreover, the weapon is installed in a mount with restriction of the weapon rotation in the horizontal and the vertical plane.

Moreover, the weapon includes a laser target designator in a sealed casing.

Moreover, the bullet-trap includes a changeable decorative coating.

The inventive features specified in the first independent and its dependent patent claims allows one to perform effective teaching and training and to carry out sports competitions in underwater shooting in a stationary pool. Shooting safety is provided by the fact that shooting positions are partitioned from targets, but are not separated into sections, shooters see each other's actions, shoot through embrasures, are watched by trainers and could not get into shooting zone near the targets. For trapping of harpoons and bullets that accidentally fly out of the water, the above-water part of the Aquatir behind the targets is covered by a bullet-trap while the pool is not divided into sections by longitudinal screens from which harpoons and bullets can ricochet.

Shooters can be comfortably placed at shooting positions even in pools of minimal length.

If the length of the swimming part exceeds dimensions of a standard sporting pool, training and competitions in swimming and underwater shooting can be carried out in the Aquatir simultaneously making possible the creation of a new aquatic sport—underwater biathlon that includes both speed swimming and underwater shooting.

In a preferable embodiment of the invention, the partition with underwater embrasures are located in above-water shooting positions with mounted ladders to climb out from the swimming part of the pool. Having a pool of minimal length makes it possible to simultaneously shoot under the water and from the air into the water and to carry out competitions in these events of sports shooting. If the length of the swimming part exceeds dimensions of standard sports pool, the Aquatir design creates the possibility of a new aquatic sport—underwater triathlon including speed swimming and shooting against underwater targets under the water and from the air into the water.

The inventive features specified in the second independent patent claim allows one to perform effective teaching and training and to carry out sports competitions in shooting against underwater targets from the air into the water. Shooting safety is provided by shooting positions being located in one part of the pool, but are not divided into sections, shooters see the actions of each other, are watched by trainers and could not accidentally get into a shooting zone near the targets. At a specified minimal shooting angle relative to the horizon, ricochet of a bullet or harpoon from the water surface is eliminated. The angle of shooting into the water without ricochet was determined by the Applicant experimentally and comprises 7 degrees relative to the horizon for firing from smooth-bore weapon with finned underwater bullets or 10 degrees relative to the horizon for firing from a rifled weapon with underwater rotating bullets. For trapping of harpoons and bullets that ricochet from the water an above-water part of the Aquatir behind the targets is covered by the bullet-trap.

Such design of the Aquatir makes possible the creation of a new aquatic sport—hitting of underwater targets in the course of shooting from the air into the water.

In one of the embodiments of the invention, the Aquatir comprises a partition that separates the swimming part of the pool from the targets while shooting positions are located on the partition with mounted ladders to climb out from the swimming part of the pool. In such Aquatir structures it is possible to simultaneously swim and shoot from the air into the water. For example, one may shoot from a smooth-bore weapon or long-barreled rifles that are not intended for underwater shooting.

If the length of the swimming part exceeds the dimensions of a standard sports pool, the Aquatir design makes it possible to creation a new aquatic sport—underwater biathlon including both speed swimming and shooting against underwater targets from the air into the water.

Harpoon guns with a set of exchangeable harpoons having a weighted head and light-weight aft part can be used as the underwater weapon for the Aquatir. Shift of the center of the harpoon mass to its head part increases the stability and shooting accuracy both in the water and in the air. Moreover, bows and arbalests with a set of exchangeable arrows that should be equipped with a weighted head and should have no tail empennage that distorts underwater trajectory can be used as the underwater weapon. In this case, the underwater range to the targets can make up 4-6 meters and the length of the ballistic part of the pool—7 meters.

For protection of the pool, an inner lining can be used with 3-5 mm polyethylene screens that are mounted behind the targets on the underwater part of the wall and on the bottom of the pool.

4.5 mm special underwater pistols SPP-1M and 5.66 mm special underwater submachine guns APS (see for example Ardashev A. N., Fedoseev S. L., "Orudgie specialnoye, neobychnoye, exoticheskoye", Moscow, Voennaya Technika, 2001, pages 172 . . . 177) with multiple-purpose bullets (see Description to patent RU 2112205, Int. CI.6 F42 B 30/02, published on 27 Aug. 1998) can be used as fire-arms in the Aquatir. Moreover, a Kalashnikov submachine guns and 7.62 mm sporting/hunting rifled carbines of "Saiga" series, smooth-bore guns of "Saiga-410" series made according to Kalashnikov submachine gun technology and underwater ammunitions with cavitating bullet-core (see for example Description to patent RU 2268455, Int. CI.7 F42B 10/38, published on 20 Jan. 2006) can be used. For firing from the air into the water, any small arms or sporting/hunting weapons can be used. Further, for firing in the Aquatir a specially designed sporting weapon, for example revolvers, short-barreled rifles and revolver guns can be used.

In the case of use of fire-arms, the underwater range to the targets and the length of the ballistic part of the pool is restricted by water transparency and can comprise 15-20 meters. The wall of the pool behind the targets should be covered by a bullet-trap. As necessary for protection of the pool, an inner lining can be used. 4-6 mm steel shields may be mounted behind the targets on the underwater part of the wall and on the bottom of the pool.

In the present invention, which teaches shooting under the water and from the air into the water, the weapon is installed in a mount which provides rigid weapon fixation and restriction of weapon rotation angle. For example, in the case of rigid weapon fixation aiming into the target is carried out by a trainer who takes into account optical refraction in the water, a trainee that memorizes a correction value, shoots and then estimates a result of shooting. This variant increases teaching efficiency and provides safety for other people in the training shooting course.

For an increase of effectiveness of teaching and training, the weapon can be installed with a laser target designator.

For safe underwater shooting, the arrangement of the target relative to the shooting position must be a negative angle of weapon pointing comprising not less than 1 degree from the horizon. This variant reduces the probability of accidental flight of a cavitating bullet out of the water and has been successfully applied by the Applicant of the present invention for underwater shooting in practice.

In the particular embodiment of this invention for underwater shooting from a firearm behind and on both sides of the shooting position, sound-absorbing screens are mounted. That variant reduces the effect on the shooter of shock wave reflected from the pool walls.

In accordance with one of the embodiment of the invention, it is reasonable to install on the bullet-trap a decoration coating that could be changed after deterioration of its appearance.

For firing from firearms it is preferable to use flat steel targets attached with the capability of rotation from the shooting position in the window of the metal frame with an upper shield. After impact of the bullet, the target turns round in a horizontal plane. The target hitting is instantly obvious and ricochet upwards is eliminated. Further, a deformable bullet does not form a cavity and quickly stops in the water. In the case of hitting a steel frame, the bullet is deformed and stops at once, and in the case of ricochet, the upper shield prevents its flight out of the water. This structure has a long lifetime and the targets are easily arranged into initial position.

In one embodiment of the invention, flat targets are made of fragile material, for example, ceramics, and are installed in windows of a steel frame. This variant allows for certain hitting determination of the target, which is crashed after hitting and raises staginess of competitions.

In one embodiment of this invention, the underwater target is made in the form of an inflatable sphere that is prevented from emergence by an anchor attached with a line. That inflatable sphere could be transparent and illuminated by an inner source of light whose sealed battery is installed in the anchor and the line comprises a conductive wire. This variant allows for certain hitting determination of the target, which bursts after hitting and raises staginess of competitions and eliminates the possibility of core deformation and ricochet after impact with the target.

For further raise of competition staginess, a floating object could be placed in the inflatable target. For example, a hollow ball can be used. In the case when several inflatable targets are used for a limited number of shots, floating balls could be marked with figures (letters) indicating score points.

In one embodiment of this invention, inflatable spheres with inner illumination are attached to one anchor and are illuminated for a short time period in definite order. Shooting is performed against illuminated targets that raise training effectiveness and competition staginess.

In another embodiment of this invention, an inflatable and illuminated target is suspended on a radio-controlled buoy having its own engine, while the anchor with a power supply does not touch the pool bottom and allows it to move the target in a horizontal plane. That raises staginess of team events where one team controls the target and the other tries to hit it.

In yet another embodiment of this invention, underwater inflatable and illuminated targets with anchors are suspended on an above-water mechanical drive that moves targets in the vertical and horizontal planes. Shooting against mobile targets raises training effectiveness and competition staginess.

In an Aquatirs for shooting arrows, harpoons and cavitating bullets are used and intended for underwater hunting; therefore in this embodiment, captured live fish swimming in an area enclosed by a net can be used as targets. That variant of the invention allows one to carry out practical trainings in underwater hunting and killed fish could be cooked on demand.

An Aquatir should comprise all of the features of a shooting gallery including a room for storage of weapons and ammunitions, as well as all features of a swimming pool with different entertaining and health-improving services that could be offered.

It is better to carry out competitions and trainings in underwater shooting galleries with an artificial pool having water of standard transparency and temperature. As necessary, an Aquatir with the above-water fencing could be placed on the shore of an open water area. Sportsmen could use equipment of military divers, competitions in speed swimming can be carried out under the water and competitors can wear outfit of underwater hunters (without aqualung). To provide safety, the audience should be placed around the swimming part of the pool and could be protected by a transparent bullet-proof partition.

The invention is explained in more detail with actual examples that in no way reduce the volume of claims and are only intended for better understanding of the invention to one of skill in the art.

BRIEF DESCRIPTIONS OF THE DRAWINGS

In description of specific embodiments of the invention there are reference to the accompanying drawings that show the following:

DESCRIPTION OF THE PREFERRED EMBODIMENT

Figure 1:
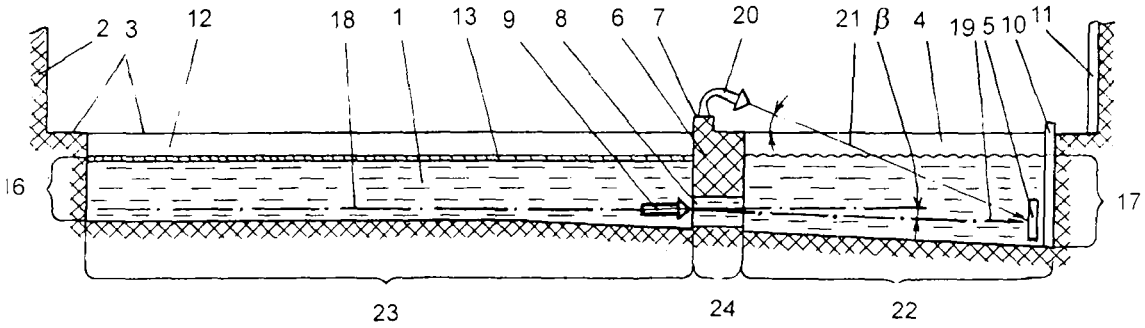
FIG. 1 and FIG. 2 show the first embodiment of the Aquatir according to the invention with a stationary partition.
Figure 2:
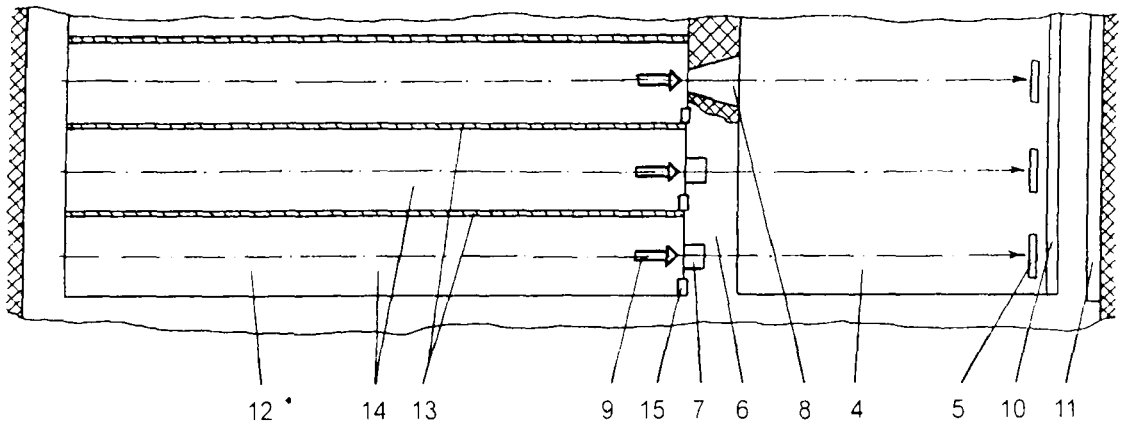

FIG. 1 shows a longitudinal cross-section of the Aquatir pool intended for swimming and shooting under the water and from the air into the water, and FIG. 2 shows a top plan view of the Aquatir pool.

The Aquatir comprises a water-filled pool 1 with a nosing 3 and above-water walls 2. A ballistic part 4 of the pool with underwater targets 5 is separated by a transversal partition 6 with starting stands 7 and underwater embrasures 8 through which shooting positions 9 are performed in underwater shooting. The embrasures 8 can have a rectangular or round transversal cross-section and a straight or conical longitudinal cross-section.

It is advisable to install the target 5 at the range of 0.5-0.8 m from an underwater bullet-trap 10 that should completely cover the pool wall while the outer wall behind targets should be covered by an above-water bullet-trap 11 having a width more than the width of the pool and a height more than 2 m. The bullet-traps 10 and 11 could be made of dense rubber or of wood and for better light-reflection and illumination of the Aquatir, it could have a bright decorative coating with fragments that could be replaced after deterioration of their appearance.

A swimming part 12 of the pool is divided by ropes 13 into tracks 14 having a standard width. Starting stands 7, underwater embrasures 8, shooting positions 9 and targets 5 are placed along the axis of the tracks 14. Ladders 15 are intended for exit from the water onto the transversal partition and are mounted at the end of the tracks 14.

The depth 16 in the shallow part of the pool could be standard, while the depth 17 near the targets should be more than the depth 16 in the shallow end and should allow one to install the targets 5 lower than the shooting positions 9 that provide a negative angle of weapon pointing $\beta$ relative to horizon and a downward tilt of shooting trajectory 19.

Shooting from the air against the underwater target 5 is performed from an above-water shooting position 20, and for a better view of the targets 5 this shooting could be performed from the highest place on the partition 6, for example from the staring stand 7. To eliminate ricochet during the pass of the cavitating core from the air into the water the arrangement of targets should provide a tilt angle $\phi$ with a trajectory 21 not less than 10 degrees to the horizon taking into account the fact that the underwater target is distinctly seen under the water at the angle more than 15 degrees relative to the horizon.

Depending on the power of firearms, the aiming range of underwater shooting can comprise 15-30 m and is limited by visibility in the water; therefore length 22 of the ballistic part 4 of the pool is chosen taking into consideration visibility in the water and may comprise 16-21 m.

To provide equal conditions during sporting competitions in underwater shooting, it is advisable to choose a single range to the underwater targets 5, for example 15m, while the length 23 of the pool swimming part 12 may be standard and may comprise 25 m or 50 m. For access to the starting stands 7 and for shooting from the air into the water, the width 24 of the transversal partition 6 may comprise 1.2-2.0 m.

The lining of the pool 1, nosing 3 and transversal partition 6 is made of a standard coating. Walls 2 may have sound-absorbing lining that reduces reflected sound of the shots in the air.

For teaching shooting under the water and from the air into the water, the weapon can be installed in a mount at the shooting position 9 or in the underwater embrasure 8 or can be installed in a mount in the front of the starting stand 7.

Training and sports competitions in underwater and above-water shooting can comprise speed swimming; for example, a competitor from one team with the help of a remote control moves a target attached to radio-controlled buoy having its own engine and a shooter from the other team tries to hit this target. After hitting the target, the competitors swim to the buoy trying to reach it first to bring it to a definite place and to score points for their teams. After that, they exchange roles.

During the competitions, shooting is performed off-hand, and competitions in swimming and shooting can be carried out taking into account the time and shooting results. For example, a sportsmen in an outfit of underwater hunters may carry out competitions in the following succession:

- sportsmen simultaneously dive with a weapon from the starting stands 7 into the water and swim a specified distance along the tracks 14;
- then the sportsman holds his breath, dives to an underwater embrasure 8 and shoots under the water against the targets 5 trying to hit a maximal number of targets in the course of one dive;
- after underwater shooting, the sportsman swims a specified distance again, then with the weapon, he climbs the ladder 15, gets onto the transversal partition 6 and shoots against the targets 5 trying to hit a maximal number of targets with one allowance of ammunition (cartridge clip);
- after shooting in the air, the sportsman reloads his weapon, dives into the water and continues competition.

A sportsman in military divers equipment can carry out competitions in the same succession, and an aqualung allows one to hit more targets during underwater shooting.

The total length of the full-size pool intended for speed swimming and shooting may comprise 65-70 m. For this purpose, the 50 m pool should be attached to the ballistic part 4 with a length of 15-20 m. If in a 50 m pool the ballistic part 4 is separated by the partition 6, then the length of the swimming part 12 comprises 30-35 m. If speed swimming is excluded, then a 25 m pool could be used as the underwater shooting gallery, where the ballistic part 4 is separated by the partition 6 and the swimming part 12 that comprises 4-9 m is used for the shooting positions 9.

Figure 3:
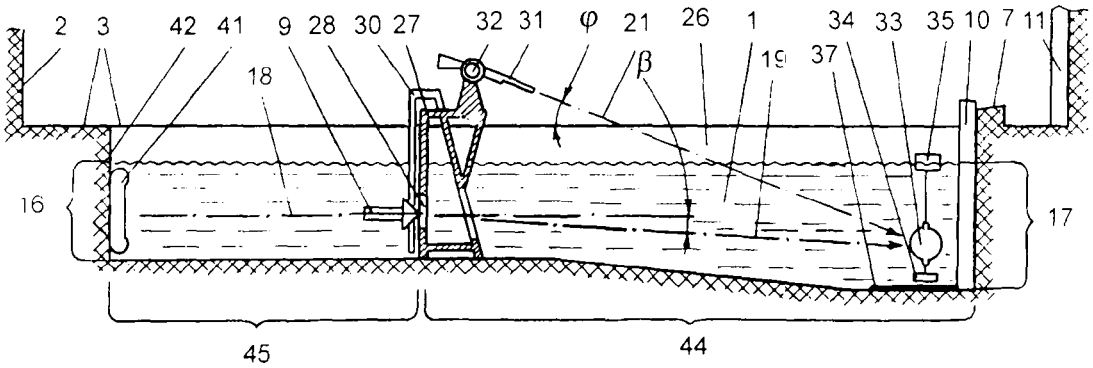
FIG. 3 and FIG. 4 show the second embodiment of the Aquatir according to the invention with a removable partition.
Figure 4:
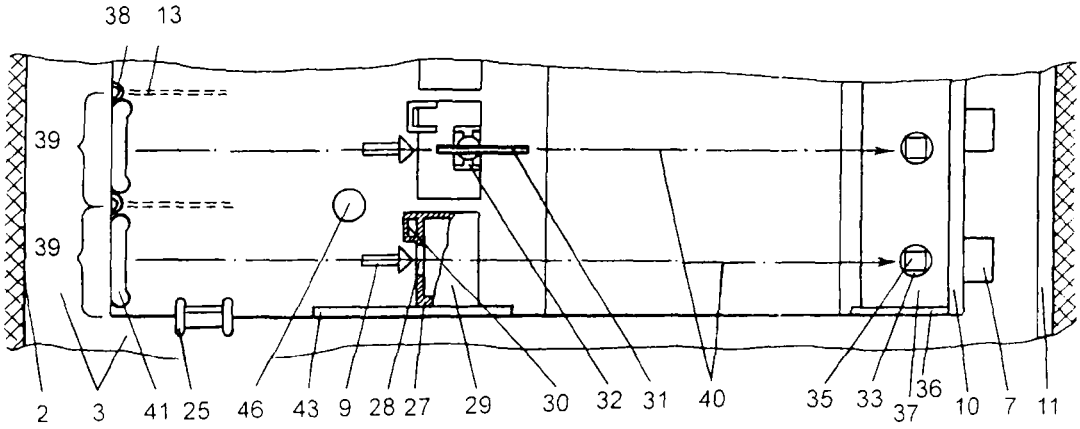

FIG. 3 shows a longitudinal cross-section of a 25 m pool of the underwater shooting gallery intended for shooting under the water and from the air into the water, and FIG. 4 shows a top plan view of the Aquatir pool.

The Aquatir comprises a water-filled pool 1 with a nosing 3, ladders 25 and above-water walls 2. A ballistic part 26 of the pool is separated by partitions 27 with underwater embrasures 28 through which shooting positions 9 are performed for underwater shooting. For access to the above-water shooting positions 29, a ladder is mounted on the partition 27. For teaching in above-water shooting, a weapon 31 could be installed by a trainer on a mount 32. To eliminate ricochet during a pass of a cavitating bullet or harpoon from the air into the water, the arrangement of a target 33 should provide a tilt angle $\phi$ of a trajectory 21 not less than 10 degrees to the horizon. As a target could be used, an inflatable sphere 33 that is prevented from emergence by an anchor 34 and is suspended on a buoy 35 with a radio-controlled engine that can move the target in the horizontal plane. After hitting, the sphere 33 bursts and all other target components are assembled with a new sphere.

Walls of the Aquatir behind the targets are covered with an underwater bullet-trap 10 and an above-water bullet-trap 11. The depth 16 in the shallow part of the pool could be standard, while the standard depth 17 near the starting stands 7 should be more than the depth 16 in the shallow part and should allow one to install the targets 33 lower than the shooting positions 9 that provide a negative angle of weapon pointing $\beta$ relative to the horizon 18. The tilt of shooting the trajectory 19 is downward. For protection of the inner lining of the pool in the region of the targets, a side screen 36 and bottom screens 37 are mounted. The material of which depends on the kind of underwater weapons.

The pool could be divided by standard ropes 13 attached to brackets 38. The width of the tracks 39 could be standard and shooting line 40 could coincide with the track axis.

To reduce the effect on the shooter of reflected shock waves from an underwater shot behind the shooting positions 9, sound-absorbing screens 41 are mounted that could be made as inflatable mattresses or could be made of sheet rubber and attached under the water at the distance of 5-10 cm from a pool wall 42.

In the side tracks along the side walls of the pool near shooting positions 9 are mounted sound-absorbing screens 43 that reduce the effect on the shooter of reflected shock waves from an underwater shot.

A length 44 of the pool ballistic part 26 may comprise 16 m and is chosen taking into account that the underwater distance from the embrasure 28 to the target 33 is 15 m. Then the length of the swimming part of the pool with the shooting position 9 comprises 9 m.

During teaching in underwater shooting, the weapon could be installed in the embrasure 28 of the partition 27. Shooting is performed with a trainer who is located in the water in zone 46.

After completion of shooting, the partitions 27 could be removed, and training in swimming could be carried out in the full length of the pool.

The Aquatir could also be arranged in an 8-10 m pool. In this case, the partitions 27 should be mounted at the distance of 2 meters from the pool wall 42 and the thickness of the bullet-traps 10 and 11 should be increased. It is advisable to carry out shooting from the air into the water from the shooting position 29 equipped with a rubber coating.

INDUSTRIAL APPLICABILITY

The invention will find its application in the design of Aquatirs (shooting galleries-pools) intended for teaching, training and carrying out of sporting competitions in shooting under the water and from the air into the water from pneumatic and missile weapons and fire-arms, where it is also possible to combine shooting with speed swimming.

The structure of Aquatirs allows one to create new aquatic sports:

- an underwater biathlon that includes both speed swimming and underwater shooting against underwater targets;
- an underwater double-event that includes speed swimming and shooting against underwater targets under the water and from the air into the water;
- a competition in marksmanship for shooting against underwater targets under the water and from the air into the water.

The invention claimed is:

1. An Aquatir comprising a water-filled pool formed by walls, an above water fencing, at least one shooting position with a weapon and at least one underwater target characterized in that the pool is equipped with a transversal partition that separates the pool swimming area with a shooting position from the pool ballistic area with an underwater target, and the transversal partition in front of each shooting position has at least one underwater embrasure, and the above water part of the pool wall and the above water fencing located behind the underwater targets are equipped with bullet traps.

2. The Aquatir in accordance with claim 1, equipped with at least one additional shooting position for shooting from the air into the water located on the transversal partition, and an underwater target installed with the capability of restricting the vertical pointing angle of the weapon that is not less than 10 degrees relative to the horizon.

3. The Aquatir in accordance with claim 1, wherein the transversal partition has at least one ladder to climb out from the pool swimming area.

4. The Aquatir in accordance with claim 1, wherein the transversal partition is partially or completely made of transparent material.

5. The Aquatir in accordance with claim 1, wherein the underwater target is installed with the capability of restricting the vertical pointing angle of the weapon from the underwater embrasure that is not less than 1 degree relative to the horizon.

6. The Aquatir in accordance with claim 1, wherein the underwater target is made in the form of an inflatable figure and is equipped with an anchor.

7. The Aquatir in accordance with claim 1, wherein the underwater target is made in the form of a transparent inflatable figure with a source of light of permanent or periodic effect inside and is equipped with an anchor.

8. The Aquatir in accordance with claim 1, wherein the underwater target is made in the form of an inflatable figure, is equipped with a weight and is suspended on a floating buoy with the capability of motion in a horizontal and/or a vertical plane.

9. The Aquatir in accordance with claim 1, wherein the underwater target is made in the form of a transparent inflatable figure with a source of light of permanent or periodic effect inside, is equipped with a weight and is suspended on a floating buoy with the capability of motion in a horizontal and/or a vertical plane.

10. The Aquatir in accordance with claim 1, wherein the underwater target is made in the form of an inflatable figure, is equipped with a weight and is suspended on a mechanical drive with the capability of motion in a horizontal and/or a vertical plane.

11. The Aquatir in accordance with claim 1, wherein the underwater target is made in the form of a transparent inflatable figure with a source of light of permanent or periodic effect inside, is equipped with a weight and is suspended on a mechanical drive with the capability of motion in a horizontal and/or a vertical plane.

12. The Aquatir in accordance with claim 1, wherein captured live fish swimming in the area enclosed by a net are used as a target.

13. The Aquatir in accordance with claim 1, wherein harpoon guns with harpoons having weighted heads and lightened aft parts are used as the weapon and the swimming pool wall behind the underwater target has a protective screen.

14. The Aquatir in accordance with claim 1, wherein bows and/or arbalests with arrows having weighted arrowheads and lightened aft parts without empennage are used as the weapon and the swimming pool wall behind the underwater target has a protective screen.

15. The Aquatir in accordance with claim 1, wherein firearms are used as the weapon and the swimming pool wall behind the underwater target is equipped with a bullet trap and the bottom and side walls of the pool have protective screens.

16. The Aquatir in accordance with claim 1, wherein sound absorbing shields are mounted behind and on the sides of the shooting position.

17. The Aquatir in accordance with claim 1, wherein the weapon is installed in a mount with a restriction of the weapon rotation in a horizontal and a vertical plane.

18. The Aquatir in accordance with claim 1, wherein the weapon has a laser target designator in a sealed casing.

19. The Aquatir in accordance with claim 1, wherein the bullet trap has a changeable decorative coating.

20. An Aquatir comprising a water-filled pool formed by walls, an above water fencing, at least one shooting position with a weapon and at least one underwater target characterized in that the shooting position is located above the water on one side of the pool, and the underwater target is equipped with a weight and installed in the pool with the capability of restricting the vertical pointing angle of the weapon that is not less than 10 degrees relative to the horizon, and the above water part of the pool wall and the above water fencing located behind the underwater targets are equipped with bullet traps, and wherein the underwater target is made in the form of a transparent inflatable figure with a source of light of permanent or periodic effect inside.

21. The Aquatir in accordance with claim 20, wherein the pool is equipped with a transversal partition that separates the pool swimming area from the pool ballistic area with underwater targets, the shooting position being located on the transversal partition, which has at least one ladder to climb out from the pool swimming area.

22. The Aquatir in accordance with claim 20, wherein the weight is made as an anchor.

23. The Aquatir in accordance with claim 20, wherein the underwater target is suspended on a floating buoy with the capability of motion in a horizontal and/or a vertical plane.

24. The Aquatir in accordance with claim 20, wherein the underwater target is suspended on a mechanical drive with the capability of motion in a horizontal and/or a vertical plane.

25. An Aquatir comprising a water-filled pool formed by walls, an above water fencing, at least one shooting position with a weapon and at least one underwater target characterized in that the shooting position is located above the water on one side of the pool, and the underwater target is equipped with a weight and installed in the pool with the capability of restricting the vertical pointing angle of the weapon that is not less than 10 degrees relative to the horizon, and the above water part of the pool wall and the above water fencing located behind the underwater targets are equipped with bullet traps, and wherein the underwater target is made in the form of an inflatable figure and is suspended on a floating buoy with the capability of motion in a horizontal and/or a vertical plane.

26. The Aquatir in accordance with claim 25, wherein captured live fish swimming in the area enclosed by a net are used as a target.

27. The Aquatir in accordance with claim 25, wherein the pool is equipped with a transversal partition that separates the pool swimming area from the pool ballistic area with underwater targets, the shooting position being located on the transversal partition, which has at least one ladder to climb out from the pool swimming area.

28. An Aquatir comprising a water-filled pool formed by walls, an above water fencing, at least one shooting position with a weapon and at least one underwater target characterized in that the shooting position is located above the water on one side of the pool, and the underwater target is equipped with a weight and installed in the pool with the capability of restricting the vertical pointing angle of the weapon that is not less than 10 degrees relative to the horizon, and the above water part of the pool wall and the above water fencing located behind the underwater targets are equipped with bullet traps, and wherein the underwater target is made in the form of an inflatable figure and is suspended on a mechanical drive with the capability of motion in a horizontal and/or a vertical plane.

29. The Aquatir in accordance with claim 28, wherein the pool is equipped with a transversal partition that separates the pool swimming area from the pool ballistic area with underwater targets, the shooting position being located on the transversal partition, which has at least one ladder to climb out from the pool swimming area.

* * * * *